US008144102B2

(12) United States Patent
Takatoku

(10) Patent No.: US 8,144,102 B2
(45) Date of Patent: Mar. 27, 2012

(54) MEMORY ELEMENT AND DISPLAY DEVICE

(75) Inventor: Makoto Takatoku, Kanagawa (JP)

(73) Assignee: Sony Corporation, Tokyo (JP)

( * ) Notice: Subject to any disclaimer, the term of this patent is extended or adjusted under 35 U.S.C. 154(b) by 730 days.

(21) Appl. No.: 12/248,646

(22) Filed: Oct. 9, 2008

(65) Prior Publication Data

US 2009/0102751 A1 Apr. 23, 2009

(30) Foreign Application Priority Data

Oct. 17, 2007 (JP) ..... 2007-270119

(51) Int. Cl.
*G09G 3/36* (2006.01)

(52) U.S. Cl. ..... 345/98

(58) Field of Classification Search ..... 345/98, 345/310

See application file for complete search history.

(56) References Cited

U.S. PATENT DOCUMENTS 6,806,862 B1 * 10/2004 Zhang et al. ..... 345/103
7,351,623 B2 * 4/2008 Ahn ..... 438/158
7,612,749 B2 * 11/2009 Libsch et al. ..... 345/82
2002/0024485 A1 * 2/2002 Koyama ..... 345/87
2007/0052647 A1 * 3/2007 Chen ..... 345/92
2008/0007816 A1 * 1/2008 Maeda ..... 359/296

FOREIGN PATENT DOCUMENTS

JP 11-052416 2/1999
JP 2000-131713 A 5/2000
JP 2003-151990 A 5/2003
JP 2007-08-09 A 8/2007
WO 2007-023011 A2 3/2007

OTHER PUBLICATIONS

M. Senda et al.; Ultra-Low-Power Polysillicon AMLCD with Full Integration; SID 02 Digest.
Japanese Patent Office, Office Action issued in Patent Application JP 2007-270119, on Nov. 10, 2009.

* cited by examiner

*Primary Examiner* — Richard Hjerpe
*Assistant Examiner* — Sahlu Okebato
(74) *Attorney, Agent, or Firm* — SNR Denton US LPP

(57) ABSTRACT

The present invention provides a memory element includes a thin film transistor configured to have a semiconductor thin film and a pair of gate electrodes that vertically sandwich the semiconductor thin film with intermediary of insulating films therebetween, and a capacitor configured to be connected to a first gate electrode of the pair of gate electrodes, wherein data is stored in the capacitor connected to the first gate electrode, and data stored in the capacitor is read out by controlling a second gate electrode of the pair of gate electrodes.

8 Claims, 11 Drawing Sheets

| S-GATE / F-GATE | LL | L | H |
|---|---|---|---|
| L | OFF | OFF | ON |
| H | OFF | ON | ON |

MEMORY ELEMENT AND DISPLAY DEVICE

CROSS REFERENCES TO RELATED APPLICATIONS

The present invention contains subject matter related to Japanese Patent Application JP 2007-270119, filed in the Japan Patent Office on Oct. 17, 2007, the entire contents of which being incorporated herein by reference.

BACKGROUND OF THE INVENTION

1. Field of the Invention

The present invention relates to memory elements. Specifically, the present invention relates to a memory element suitable for pixel driving of an active-matrix display device. Furthermore, the present invention relates to an active-matrix display device for which such a memory element is formed in each pixel.

2. Description of Related Art

An active-matrix liquid crystal display device includes gate lines on rows, data lines on columns, and pixels disposed at the intersections of the gate lines and the data lines. In each pixel, an electro-optical element typified by a liquid crystal cell and an active element, such as a thin film transistor, for driving the electro-optical element are formed. The gate of the thin film transistor is connected to the gate line, the source thereof is connected to the data line, and the drain thereof is connected to the electro-optical element. The active-matrix display device line-sequentially scans the gate lines and supplies video signals (data) to the column data lines in linkage with the gate line scanning, to thereby display an image dependent upon the video signals on a pixel array.

Specifically, the active-matrix display device line-sequentially scans the gate lines every one field and supplies the video signals to the data lines in linkage with this scanning. In the case of displaying of a moving image, the picture on the screen is switched every one field, and therefore charging and discharging of the video signals in the data lines needs to be repeated every one field. In the driving of the panel of the active-matrix display device, most of the power consumption is due to the charging and discharging of the data lines.

To suppress the power consumption due to the charging and discharging, it is effective to decrease the frequency of the image rewriting (field frequency). However, it is well known that decreasing the field frequency to a value in the range of 30 to 60 Hz or lower causes flicker on the screen and thus deteriorates the display characteristics. To address this problem, as a related-art scheme for saving the power consumption without decreasing the field frequency, a system has been proposed in which a memory function is incorporated in each pixel to thereby decrease the number of times of charging and discharging. For example, this system is disclosed in Japanese Patent Laid-open No. Hei 11-52416 and M. Senda et al. "Ultra low power polysilicon AMLCD with full integration" SID2002, p 790.

Studies have been advanced for a technique to decrease the number of times of charging and discharging of the data lines and thereby reduce the power consumption by continuing displaying of the data held by the memory function in the pixel when the input video signal does not change, such as when a still image is being displayed.

For example, there has been proposed a system in which an SRAM memory element is integrated in each pixel in order to incorporate the memory function in the pixels in a liquid crystal panel. However, for the SRAM memory element, at least six transistors are used per one bit. Therefore, if six bits are assigned to each one pixel and thus 64-grayscale displaying is intended, 6×6=36 transistors need to be integrated per one pixel, which correspondingly puts pressure on the effective aperture area of the pixels. Because the area of the pixel aperture that allows the passage of a light beam from a backlight necessary for displaying is decreased, a bright screen cannot be obtained. Thus, in the case of incorporating a related-art memory element in the pixels as it is, increase in the number of bits is difficult, which imposes the limit to high-definition multi-grayscale displaying; this problem should be solved.

The above-mentioned Japanese Patent Laid-open No. Hei 11-52416 discloses an example in which ferroelectric is used as a system for realizing the memory function incorporated in the pixels. In this system, there is no fear of putting pressure on the aperture area because a circuit element such as a transistor does not need to be formed in each pixel. However, a material proper for the ferroelectric having the memory function is very few, and thus this system has not yet reached the practical-use level. Specifically, it is said that the ferroelectric characteristics and the insulation properties tend to be easily changed through repetition of data rewriting and therefore it is difficult to ensure the reliability of the memory function.

SUMMARY OF THE INVENTION

There is a need for the present invention to provide an ultra-small memory element that can be incorporated in a pixel. There is also another need for the present invention to provide an active-matrix display device in which such a memory element is incorporated. According to an embodiment of the present invention, there is provided a memory element including a thin film transistor configured to have a semiconductor thin film and a pair of gate electrodes that vertically sandwich the semiconductor thin film with the intermediary of insulating films therebetween, and a capacitor configured to be connected to a first gate electrode of the pair of gate electrodes. Data is stored in the capacitor connected to the first gate electrode, and data stored in the capacitor is read out by controlling a second gate electrode of the pair of gate electrodes.

According to another embodiment of the present invention, there is provided a display device including gate lines on rows, data lines on columns, and pixels disposed at the intersections of the gate lines and the data lines. Each of the pixels includes a memory element and an electro-optical element. The memory element stores data supplied from the data line and reads out data in accordance with a signal supplied from the gate line. The electro-optical element offers luminance dependent upon the stored data. The memory element includes a thin film transistor configured to have a semiconductor thin film and a pair of gate electrodes that vertically sandwich the semiconductor thin film with the intermediary of insulating films therebetween, and a capacitor configured to be connected to a first gate electrode of the pair of gate electrodes. Data is stored in the capacitor connected to the first gate electrode, and data stored in the capacitor is read out by controlling a second gate electrode via the gate line.

According to the embodiments of the present invention, the memory element includes at least one dual-gate thin film transistor and one capacitor. Depending on the case, a switch formed of a thin film transistor is added thereto. Even in this case, the memory element can be formed by total two thin film transistors and one capacitor. Thus, the memory element has a greatly-simplified circuit configuration and a decreased size compared with a related-art SRAM. A plurality of memory elements thus miniaturized can easily be incorporated into a pixel, and thus a memory with a multi-bit configuration can be incorporated in the pixel with small area. Thus, it is possible to realize an active-matrix display device that allows multi-grayscale displaying with a practical pixel size.

Because a multi-bit memory can be incorporated in the pixel, the power consumption due to charging and discharging of data lines, which occupies most part of the panel power consumption other than the power consumption of the backlight, can be reduced. Thus, an active-matrix liquid crystal display device panel that can be driven with low power consumption can be achieved. Incorporating such a liquid crystal panel into a monitor of portable apparatus allows not only extension of the interval of battery charging but also reduction in the battery volume, which can further decrease the size of the portable apparatus.

DETAILED DESCRIPTION OF THE PREFERRED EMBODIMENTS

Figure 1:
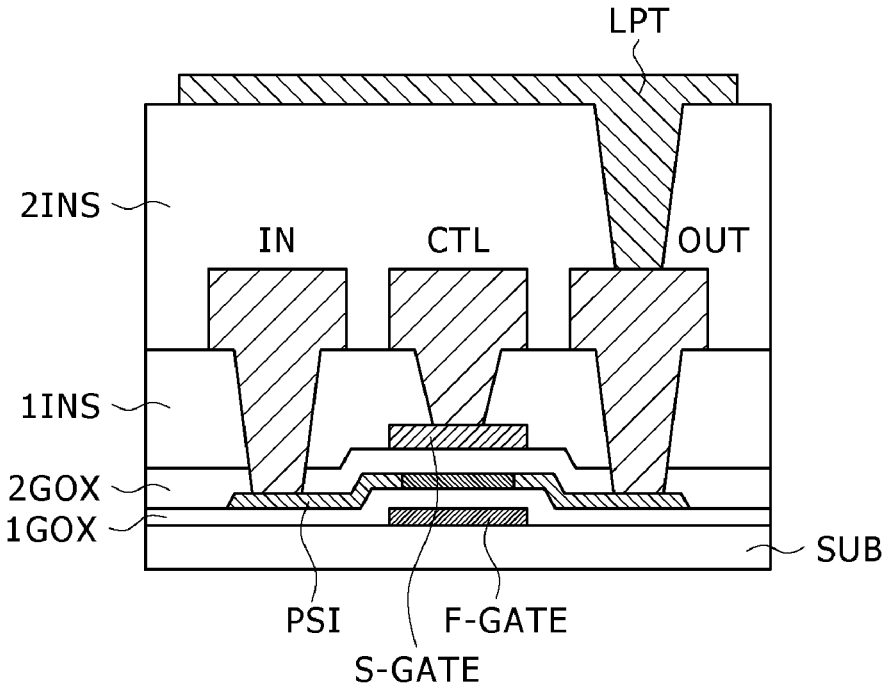
FIG. 1 is a schematic sectional view showing the structure of a memory element according to an embodiment of the present invention.

Embodiments of the present invention will be described in detail below with reference to the accompanying drawings. FIG. 1 is a schematic sectional view showing the structure of a memory element according to an embodiment of the present invention. The memory element according to the embodiment of the present invention is basically composed of a thin film transistor and a capacitor, and is formed over a substrate SUB. The thin film transistor has a semiconductor thin film PSI composed of polycrystalline silicon or the like, and a pair of gate electrodes F-GATE and S-GATE that vertically sandwich the semiconductor thin film PSI with the intermediary of insulating films 1GOX and 2GOX therebetween. The capacitor is connected to the first gate electrode F-GATE of the pair of gate electrodes, although not shown in the drawing. This capacitor can be obtained as follows. Specifically, the same conductive layer as the first gate electrode F-GATE is used as the first electrode of the capacitor, and the layer that is the same as the semiconductor thin film PSI but has decreased resistance is used as the second electrode of the capacitor. Furthermore, the insulating film 1GOX disposed between the first and second electrodes is used as the dielectric film of the capacitor. In the example of FIG. 1, the first gate electrode F-GATE connected to the capacitor is the lower electrode of the dual-gate thin film transistor. However, the present invention is not limited to this structure. It is also possible to employ the structure in which the upper gate electrode of the dual-gate thin film transistor is used as the first gate electrode.

As a feature of the embodiment of the present invention, the memory element has a configuration in which data is stored in the capacitor connected to the first gate electrode F-GATE and the data stored in the capacitor is read out through control of the second gate electrode S-GATE of the pair of gate electrodes. In the present embodiment, the upper gate electrode is used as the second gate electrode S-GATE. However, the present invention is not limited thereto but the lower gate electrode may be used as the second gate electrode. As above, the memory element according to the embodiment of the present invention is basically composed of a dual-gate thin film transistor having a pair of upper and lower gate electrodes F-GATE and S-GATE (referred to also as a sandwich-structure thin film transistor), and a capacitor. Thus, the circuit configuration of this memory element is very simpler compared with a typical SRAM memory.

The dual-gate thin film transistor and the capacitor (not shown), which are the main-body part of the memory element, are covered by a first interlayer insulating film 1INS. To the surface thereof, metal interconnects IN, CTL, and OUT are connected. The metal interconnect IN is connected to the source of the dual-gate thin film transistor as the input current terminal of the transistor. The metal interconnect CTL is connected to the second gate electrode S-GATE as the control terminal of the dual-gate thin film transistor. The remaining metal interconnect OUT is connected to the drain of the dual-gate thin film transistor as the output current terminal of the transistor. These metal interconnects IN, CTL, and OUT are covered by a second interlayer insulating film 2INS. On the second interlayer insulating film 2INS, a pixel electrode LPT as the target of the driving by the memory element is disposed. This pixel electrode LPT is connected to the output metal interconnect OUT via a contact hole opened in the second interlayer insulating film 2INS.

As is apparent from the above description, the dual-gate thin film transistor as the major part of the memory element according to the embodiment of the present invention has the input current terminal as the data input side and the output current terminal as the data output side. In a preferred mode, a switch formed of a thin film transistor is provided between the output current terminal and the capacitor for holding data. In this case, in the memory element, at the time of data writing, the second gate electrode S-GATE is controlled in the state in which this switch is in the on-state, to thereby write data supplied from the input current terminal to the capacitor. On the other hand, at the time of data reading, the second gate electrode S-GATE is controlled in the state in which this switch is in the off-state, to thereby read out the data written to the capacitor to the output current terminal. In this case, the voltage dependent upon the data written to the capacitor is applied to the first gate electrode F-GATE, and this voltage application changes the threshold voltage of the dual-gate thin film transistor. On the other hand, the data is read out by controlling the second gate electrode S-GATE and regarding the threshold voltage change as the change between the on-state and the off-state of the dual-gate thin film transistor.

Figure 2:
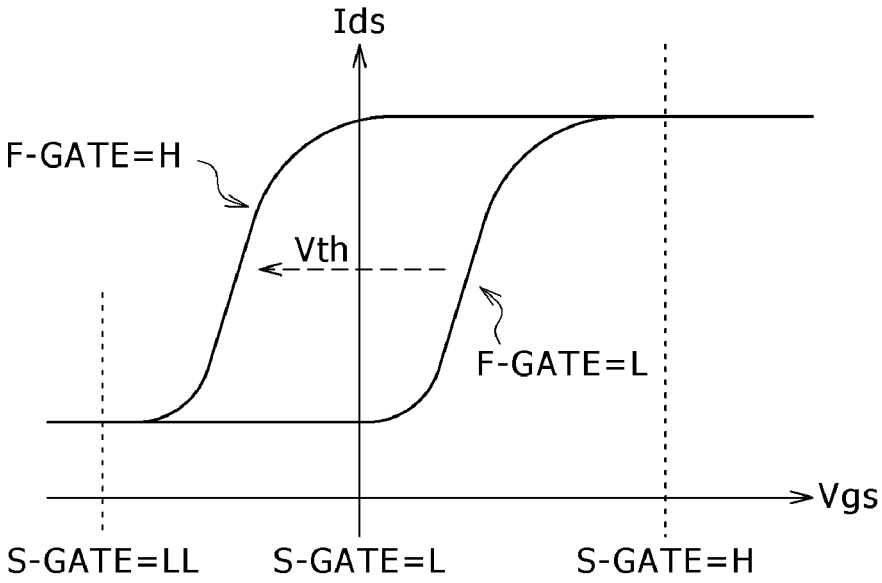
FIG. 2 is a graph for explaining the operation of the memory element shown in FIG. 1.

FIG. 2 is a graph showing the operating characteristic of the dual-gate thin film transistor shown in FIG. 1. In this graph, a gate voltage Vgs is plotted on the abscissa, and a drain current Ids is plotted on the ordinate. This gate voltage Vgs is the voltage applied to the second gate electrode S-GATE of the dual-gate thin film transistor. The drain current Ids is the current that flows between the source (input current terminal) and the drain (output current terminal) of the dual-gate thin film transistor. For this graph, the gate potential of the first gate electrode F-GATE is employed as a parameter. This gate potential changes depending on the data written to the memory element. In the present specification, the binary data written to the one-bit memory element is represented by L and H. In the graph of FIG. 2, the Vgs-Ids characteristic of the dual-gate thin film transistor is shown for two cases: F-GATE=L (i.e., when binary data 0 is written to the one-bit memory element) and F-GATE=H (i.e., when binary data 1 is written to the one-bit memory element). As is apparent from the graph, the threshold voltage Vth of the dual-gate thin film transistor changes depending on the potential of the first gate electrode F-GATE. In the example of FIG. 2, the threshold voltage Vth is high when F-GATE=L, and is low when F-GATE=H. The memory element detects the change of the threshold voltage Vth of the dual-gate thin film transistor to thereby read out the binary data.

For example, when voltage of the H level is applied to the control terminal of the dual-gate transistor (i.e. the second gate electrode S-GATE), the dual-gate thin film transistor is turned on, so that the drain current Ids flows. Subsequently, when the voltage to the control terminal is switched to the low level L (S-GATE=L), the drain current Ids is switched depending on the potential of the first gate electrode F-GATE. Specifically, when F-GATE=L, the current Ids does not flow but the dual-gate thin film transistor is in the off-state. On the other hand, when F-GATE=H, the dual-gate thin film transistor is in the on-state, and thus the current flows. In this manner, when S-GATE is set to L, the state of the dual-gate thin film transistor is switched between the on-state and the off-state depending on the potential of the first gate electrode F-GATE. In other words, the state of the thin film transistor is switched between the on-state and the off-state depending on the data written to the memory element. Furthermore, when the voltage to the control terminal is set to LL (S-GATE=LL), the dual-gate thin film transistor is in the off-state irrespective of the value of the data written to the memory element. For example, the level of S-GATE=H, which always keeps the thin film transistor at the on-state, is in the range of 5 to 6.5 V. On the other hand, the level of S-GATE=LL, which always keeps the thin film transistor at the off-state, is e.g. −8 V. Furthermore, the gate voltage S-GATE=L, which is used to read out the data written to the memory element, is e.g. 0 V.

Figures 3, 4:
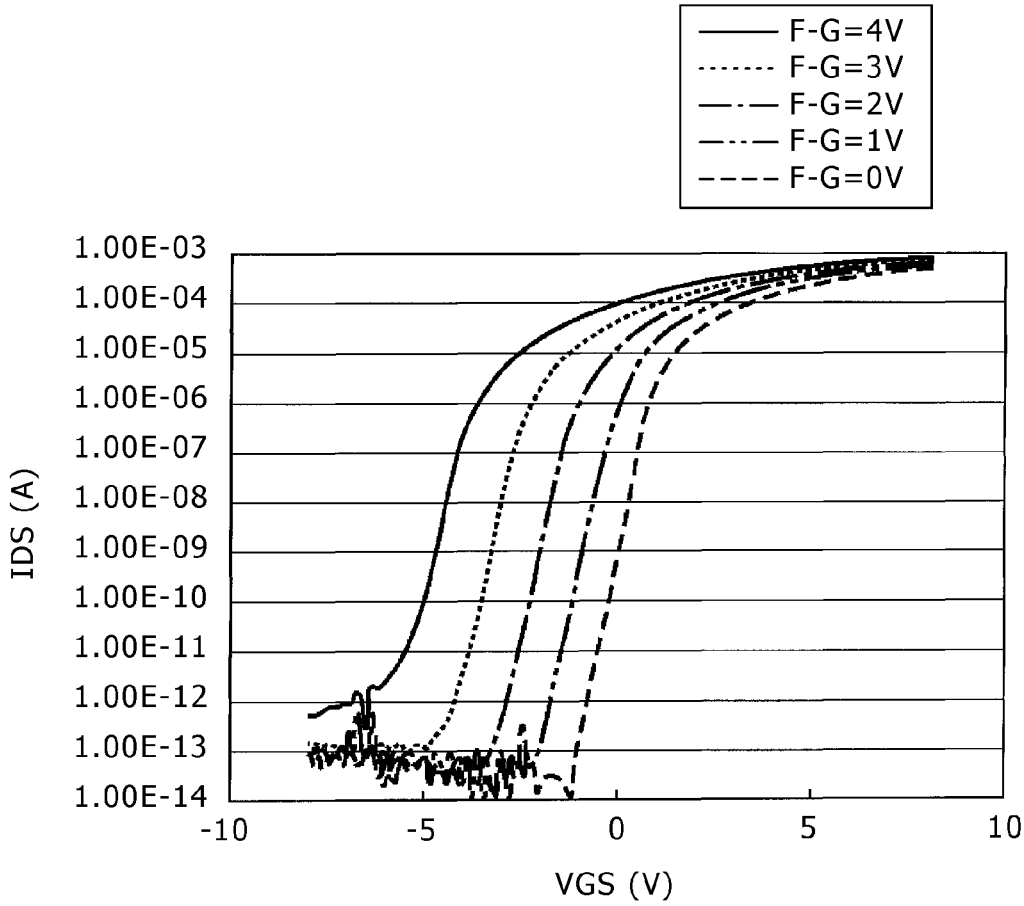
FIG. 3 is a truth table for explaining the operation of the memory element shown in FIG. 1.
FIG. 4 is a graph showing the current-voltage characteristic of a dual-gate transistor included in the memory element shown in FIG. 1.

FIG. 3 is a truth table showing the operation of the memory element shown in FIG. 2. The levels L and H of the first gate electrode F-GATE correspond to binary data 0 and 1, respectively. The levels LL, L, and H of the second gate electrode S-GATE indicate the control voltage for reading of the memory element.

For example, when S-GATE of the memory element is switched between L and H, the state of the thin film transistor is switched between the on-state and the off-state depending on the data L or H written to the memory element. When the combination of L and H of S-GATE and the combination of L and H of F-GATE shown in the truth table are considered, it becomes apparent that the memory element operates as an OR-gate element. Specifically, the memory element is OFF only when S-GATE=L and F-GATE=L, and is ON for all of the other combinations; the memory element operates as an OR-gate element.

FIG. 4 is a graph showing actual-measurement data of the Ids-Vgs characteristic of the dual-gate thin film transistor incorporated in the memory element. As described above, Vgs denotes the voltage applied to the gate electrode S-GATE as the control terminal, and Ids denotes the current that flows between the input current terminal and the output current terminal. This graph shows data obtained when the voltage applied to the first gate electrode F-GATE is switched to five stages from 0 V to 4 V. This graph makes it apparent that the threshold voltage of the dual-gate thin film transistor is shifted in response to the change of the voltage applied to the first gate electrode F-GATE. The embodiment of the present invention is made by utilizing this characteristic of the dual-gate thin film transistor and applying it to a memory element.

Figure 5A:
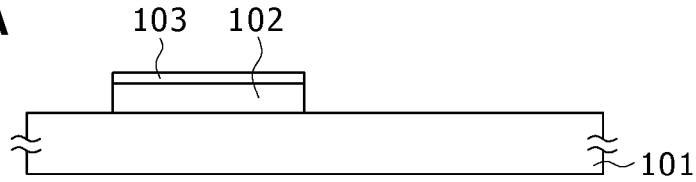
FIGS. 5A to 5F are diagrams showing steps in manufacturing of the memory element shown in FIG. 1.

FIG. 5A to 5F are schematic step diagrams showing a method for manufacturing the memory element according to the embodiment of the present invention. Initially, as shown in FIG. 5A, metal films 102 and 103 are deposited on a glass substrate 101 by e.g. sputtering. The lower metal film 102 is composed of aluminum and has a thickness of 100 nm, for example. The upper metal film 103 is composed of titanium and has a thickness of 50 nm, for example. These two metal films 102 and 103 are patterned in matching with the shape of the element region so as to be used as a light-shielding film.

Figure 5B:
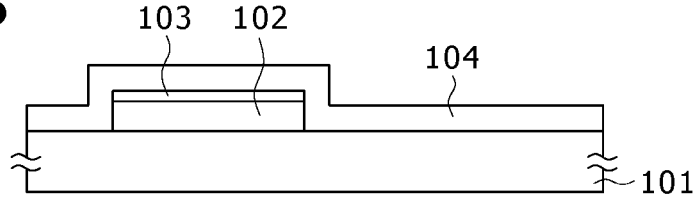

Subsequently, as shown in FIG. 5B, in order to cover the metal films 102 and 103 for light shielding by an insulator, a silicon oxide film 104 is deposited by e.g. plasma CVD to a thickness of e.g. 100 nm.

Figure 5C:
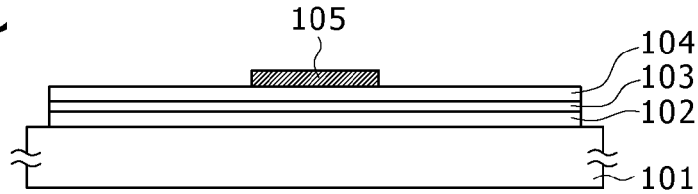

Subsequently, as shown in FIG. 5C, a metal film 105 to serve as the first gate electrode is deposited on the insulating film 104 by e.g. sputtering to a thickness of 100 nm, and then is patterned into the shape of the gate electrode. The drawing scale of FIG. 5C and the subsequent diagrams is smaller than that of FIG. 5A and FIG. 5B.

Figure 5D:
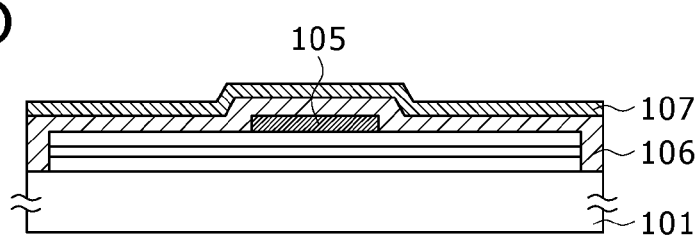

Subsequently, as shown in FIG. 5D, a first gate insulating film 106 is formed on the metal film 105 patterned as the first gate electrode. This gate insulating film 106 arises from stacking of e.g. a 50-nm-thickness silicon nitride film and a 50-nm-thickness silicon oxide film. On this first gate insulating film 106, an amorphous silicon semiconductor layer 107 is deposited to a thickness of 50 nm. The gate insulating film 106 and the amorphous silicon semiconductor film 107 are continuously deposited by plasma CVD. Thereafter, the amorphous silicon semiconductor film 107 is irradiated with excimer laser light so as to be turned to a polycrystalline film.

Figure 5E:
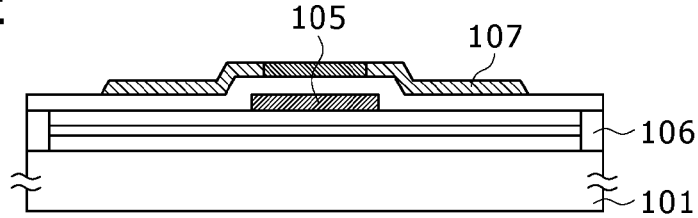

Subsequently, as shown in FIG. 5E, in the state in which the semiconductor thin film 107 turned into the polycrystalline film is covered by a mask, N-type and P-type impurities are selectively implanted into the polycrystalline silicon thin film 107 by ion-doping apparatus, to thereby form the source region and the drain region. Subsequently, the impurities implanted into the semiconductor thin film 107 are activated by using rapid thermal annealing (RTA) apparatus. Moreover, the silicon thin film 107 is patterned into an island shape in matching with the shape of the element region.

Figure 5F:
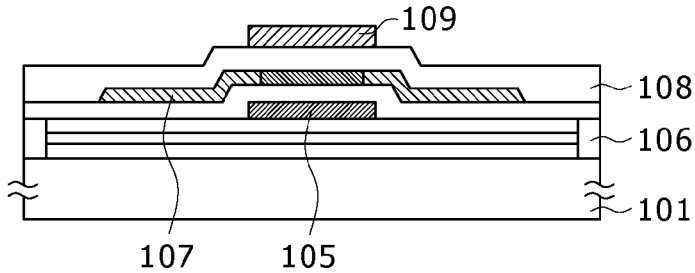

Subsequently, as shown in FIG. 5F, a second gate insulating film 108 is deposited on the semiconductor thin film 107. The second gate insulating film 108 is formed e.g. by depositing a 50-nm-thickness silicon oxide film and a 50-nm-thickness silicon nitride film by plasma CVD in a continuous manner. Thereafter, a metal film 109 to serve as the second gate electrode is deposited on the second gate insulating film 108 by e.g. sputtering. For example, the metal film 109 is formed by depositing metal molybdenum to a thickness of 100 nm by sputtering. This metal film 109 is subjected to masking in matching with the shape of the gate electrode. The metal film 109 is etched with use of the mask so as to be processed into the second gate electrode. Through the above-described steps, the basic structure of the dual-gate thin film transistor as the major part of the memory element according to the embodiment of the present invention is formed.

In the step of FIG. 5E, the capacitor is also formed simultaneously with the patterning of the polycrystalline silicon film 107. Although not shown in the diagram, the lower electrode of the capacitor is formed of a metal pattern that is the same layer as the metal film 105 to serve as the second gate electrode, and the upper electrode of the capacitor is formed of a semiconductor layer that is the same layer as the semiconductor thin film 107 but has decreased resistance. Furthermore, the dielectric of the capacitor is formed of an insulating film that is the same layer as the gate insulating film 106 sandwiched by the upper and lower electrodes.

After the step of FIG. 5F, the surfaces of the dual-gate thin film transistor and the capacitor are covered by the first interlayer insulating film. This first interlayer insulating film arises from e.g. deposition of a 300-nm-thickness silicon oxide film and a 300-nm-thickness silicon nitride film by plasma CVD. Moreover, in order to improve the quality of the polycrystalline silicon film 107 by hydrogenation, annealing at a temperature of about 400° C. is performed. A contact hole is opened in the first interlayer insulating film thus formed. Furthermore, a metal layer is formed on the first interlayer insulating film and is patterned into a predetermined shape so as to be used as the interconnect electrodes IN, OUT, and CTL. These interconnect electrodes are as shown in FIG. 1. The metal layer serving as the interconnects has e.g. a three-layer structure, and specifically, arises from stacking of a 50-nm-thickness titanium lower layer, a 500-nm-thickness aluminum middle layer, and a 50-nm-thickness titanium upper layer. Finally, the second interlayer insulating film (organic planarization film) is applied on the interconnect electrodes to thereby completely cover these interconnect electrodes. A contact hole is formed in this second interlayer insulating film (organic planarization film), and a transparent conductive film ITO is deposited thereon. This transparent conductive film ITO is patterned into a predetermined shape so as to be processed into the pixel electrode. The memory element thus completed has the sectional structure shown in FIG. 1.

Figure 6:
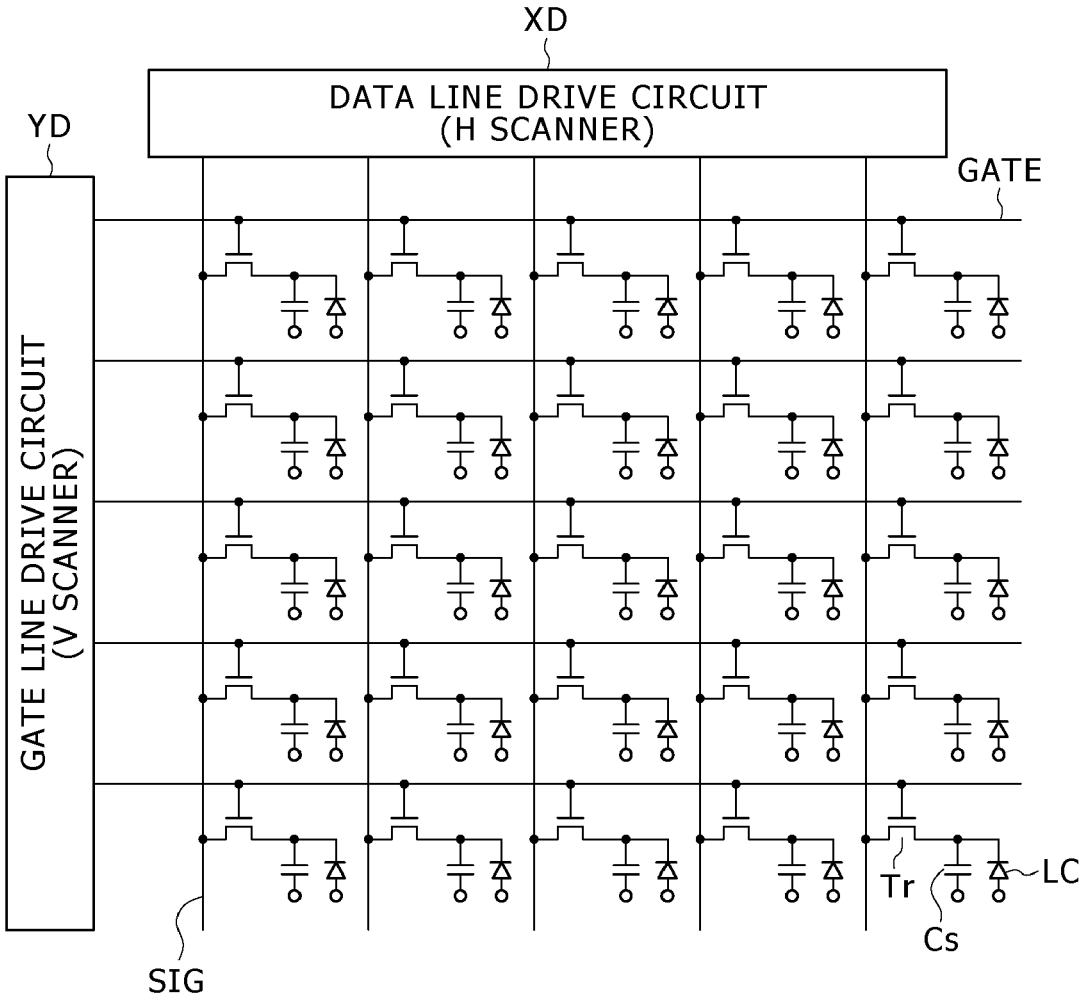
FIG. 6 is a schematic diagram showing a reference example of an active-matrix liquid crystal display device.

With reference to FIGS. 6 to 12, an active-matrix liquid crystal display device employing the memory element according to the embodiment of the present invention shown in FIGS. 1 to 5F will be described in detail below. To initially clear up the background of the present invention, the configuration of a related-art active-matrix liquid crystal display device is shown in FIG. 6. As shown in FIG. 6, the related-art active-matrix liquid crystal display device includes gate lines GATE on rows, data lines SIG on columns, and pixels disposed at the intersections of the gate lines and the data lines. Each pixel includes a liquid crystal cell LC, a holding capacitor Cs, and a drive transistor Tr. The gate of the drive transistor Tr is connected to the corresponding gate line GATE, the source thereof is connected to the corresponding data line SIG, and the drain thereof is connected to the corresponding liquid crystal cell LC and the corresponding holding capacitor Cs. The liquid crystal cell LC is composed of the pixel electrode connected to the drain of the transistor Tr, a counter electrode (common electrode) formed on the counter substrate side, and a liquid crystal held between both the electrodes.

The row gate lines GATE are line-sequentially scanned by a gate line drive circuit (V scanner) YD every one field. The column data lines SIG are connected to a data line drive circuit (H scanner) XD. The data line drive circuit XD supplies data to the column data lines SIG. The line-sequential scanning of the gate lines GATE is carried out every one filed, and the data on the data lines SIG are switched in linkage with the line-sequential scanning, which causes charging and discharging of the data lines SIG. The power consumption due to this charging and discharging occupies most of the power consumption of the active-matrix display device. The data rewrite operation in every one field needs to be carried out not only for displaying of a moving image but also for displaying of a still image on the pixel array. The reason therefor is as follows. Specifically, the drive transistor Tr involves current leakage, and the data-line rewrite operation at a field frequency of e.g. 60 Hz is needed as a countermeasure against the current leakage. That is, refreshing of the still-image screen with the field cycle needs to be carried out to address the leakage.

Figure 7:
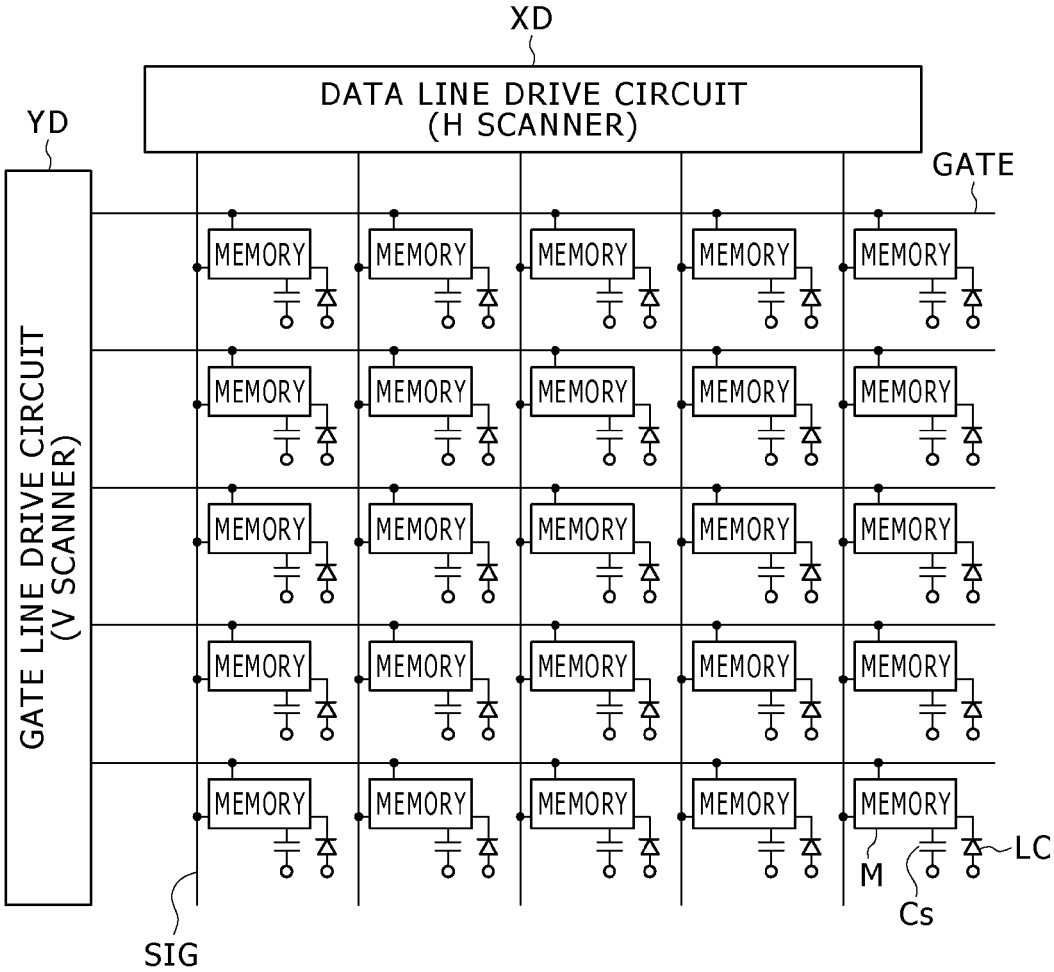
FIG. 7 is a block diagram showing the entire configuration of an active-matrix liquid crystal display device according to the embodiment.

FIG. 7 is a schematic plan view showing an active-matrix liquid crystal display device for which a memory is formed in each pixel in order to reduce the power consumption attributed to the charging and discharging of the data lines SIG. The same parts as those in the liquid crystal display device shown in FIG. 6 are given the same symbols for easy understanding. As shown in FIG. 7, this liquid crystal display device includes a memory M in each pixel. In this display device, data is held in a holding capacitor Cs and is read out in linkage with line-sequential scanning, so that a liquid crystal cell LC is driven. Disposing the memory M in each pixel allows reduction in the number of times of charging and discharging of the data lines SIG at the time of displaying of a still image. When the data rewriting does not need to be carried out, such as when a still image is being displayed, the low-power-consumption mode in which data scanning is not carried out can be employed.

Figure 8:
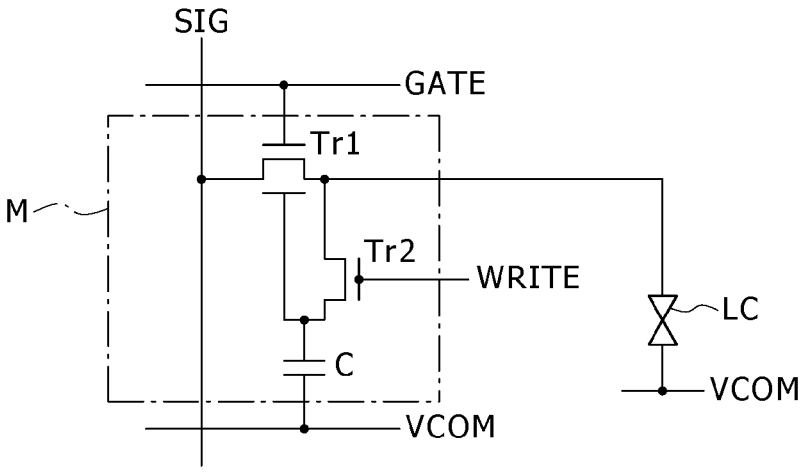
FIG. 8 is a circuit diagram showing one pixel in the liquid crystal display device shown in FIG. 7.

FIG. 8 is a circuit diagram showing one pixel in the liquid crystal display device according to the embodiment of the present invention. In other words, FIG. 8 is a circuit diagram arising from enlargement showing of one pixel included in the liquid crystal display device shown in FIG. 7. As shown in FIG. 8, one pixel includes the memory element M and an electro-optical element. The memory element M stores the data supplied from the data line SIG, and reads out the data in accordance with the signal supplied from the gate line GATE. The electro-optical element offers the luminance dependent upon the stored data. In the present embodiment, this electro-optical element is formed of a liquid crystal cell LC. This liquid crystal cell LC is a liquid crystal held between a pixel electrode and a counter electrode. A common potential VCOM is applied to the counter electrode.

The memory element M includes a thin film transistor Tr1 and a capacitor C. In FIG. 8, the holding capacitor Cs shown in FIG. 7 is represented as the capacitor C in the memory element M, for easy understanding. The thin film transistor Tr1 has a semiconductor thin film and a pair of gate electrodes that vertically sandwich the semiconductor thin film with the intermediary of insulating films therebetween, and thus has a so-called dual-gate structure. One electrode of the capacitor C is connected to the first gate electrode of the pair of gate electrodes, and the other electrode thereof is connected to the common potential VCOM. The memory element M having this structure stores data in the capacitor C connected to the first gate electrode of the dual-gate thin film transistor Tr1, and reads out the data stored in the capacitor C through control of the second gate electrode via the gate line GATE.

The dual-gate thin film transistor Tr1 has the input current terminal (source) connected to the data line SIG and the output current terminal (drain) connected to the pixel electrode of the liquid crystal cell LC. A switch formed of a thin film transistor Tr2 is interposed between this output current terminal (drain) and the capacitor C. To the gate of the thin film transistor Tr2 as the switch, a write line WRITE disposed in parallel to the gate line GATE is connected. In the memory element M having this configuration, at the time of data writing, the second gate electrode of the dual-gate transistor Tr1 is controlled via the gate line GATE in the state in which the switching transistor Tr2 is kept at the on-state via the write line WRITE, to thereby write the data supplied from the input current terminal to the capacitor C. On the other hand, at the time of data reading, the second gate electrode of the dual-gate thin film transistor Tr1 is controlled via the gate line GATE in the state in which the switching transistor Tr2 is kept at the off-state via the write line WRITE, to thereby read out the data written to the capacitor C to the output current terminal. The switching thin film transistor Tr2 is shielded from external light in order to prevent data leakage.

The operation of the memory element M of FIG. 8 will be summarized below for both the write operation and the read operation. In the write operation, the gate line GATE is turned to the H level, and thereby the thin film transistor Tr1 is switched to the on-state. Furthermore, the write line WRITE is also turned to the H level to thereby turn on the switching transistor Tr2. In this state, binary data H or L is supplied to the data line SIG. This data H or L is written to the capacitor C via the transistors Tr1 and Tr2 in the on-state. The data L or H written to the capacitor C is applied to the first gate electrode of the dual-gate transistor Tr1.

In the read operation, the gate line GATE is switched to the L level, and the write line WRITE is also switched to the L level. The data line SIG is set to the common potential VCOM. Due to this operation, the switching transistor Tr2 is turned off, so that the output current terminal of the dual-gate transistor Tr1 is isolated from the capacitor C. If the data written to the capacitor C is H, the dual-gate transistor Tr1 is in the on-state, and thus VCOM is applied to the pixel electrode of the liquid crystal cell LC from the data line SIG. Because both the pixel electrode and the counter electrode of the liquid crystal cell LC are at VCOM, no voltage is applied to the liquid crystal cell LC. On the other hand, if the data written to the capacitor C is the L level, the dual-gate thin film transistor Tr1 is in the off-state, and thus the data line SIG is isolated from the pixel electrode of the liquid crystal cell LC. Therefore, a predetermined voltage with respect to VCOM of the counter electrode side is continuously applied to the pixel electrode of the liquid crystal cell LC, and hence the display state is maintained.

Figure 9:
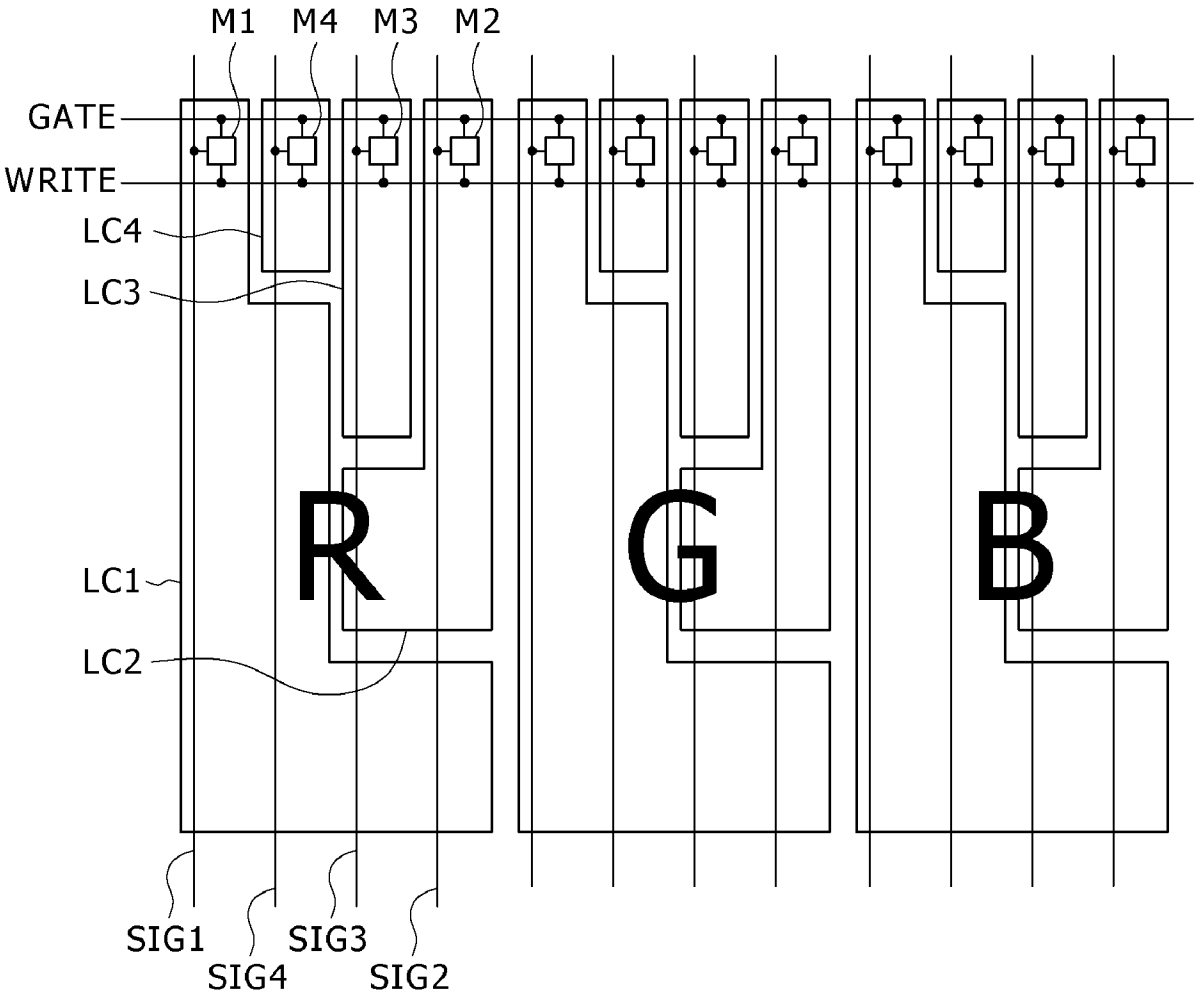
FIG. 9 is a schematic plan view of the pixel electrode layout of three pixels in the liquid crystal display device according to the embodiment.

FIG. 9 is a schematic diagram showing an application example of the pixel shown in FIG. 8. FIG. 9 shows three pixels of R, G, and B. In each pixel, area division of the pixel electrode is carried out. In other words, area division of the liquid crystal cell LC is carried out, and each pixel includes four liquid crystal cells from a liquid crystal cell LC1 having the largest area to a liquid crystal cell LC4 having the smallest area. The areas of the liquid crystal cells LC4, LC3, LC2, and LC1 arise from sequential increase by a factor of two. Memory cells M1 to M4 are connected to the liquid crystal cells LC1 to LC4, respectively. The respective memory cells M1 to M4 are connected to a common gate line GATE and a common write line WRITE. The memory cells M1 to M4 are connected to corresponding data lines SIG1 to SIG 4, respectively.

At the time of writing, the gate line GATE and the write line WRITE are turned to the high level, and multi-bit data are written from the data lines SIG1 to SIG4 to the corresponding memory cells M1 to M4, respectively. In the present example, four-bit data is written to the set of four memory cells M1 to M4, which allows displaying with 16 (=the fourth power of two) grayscales.

Figure 10:
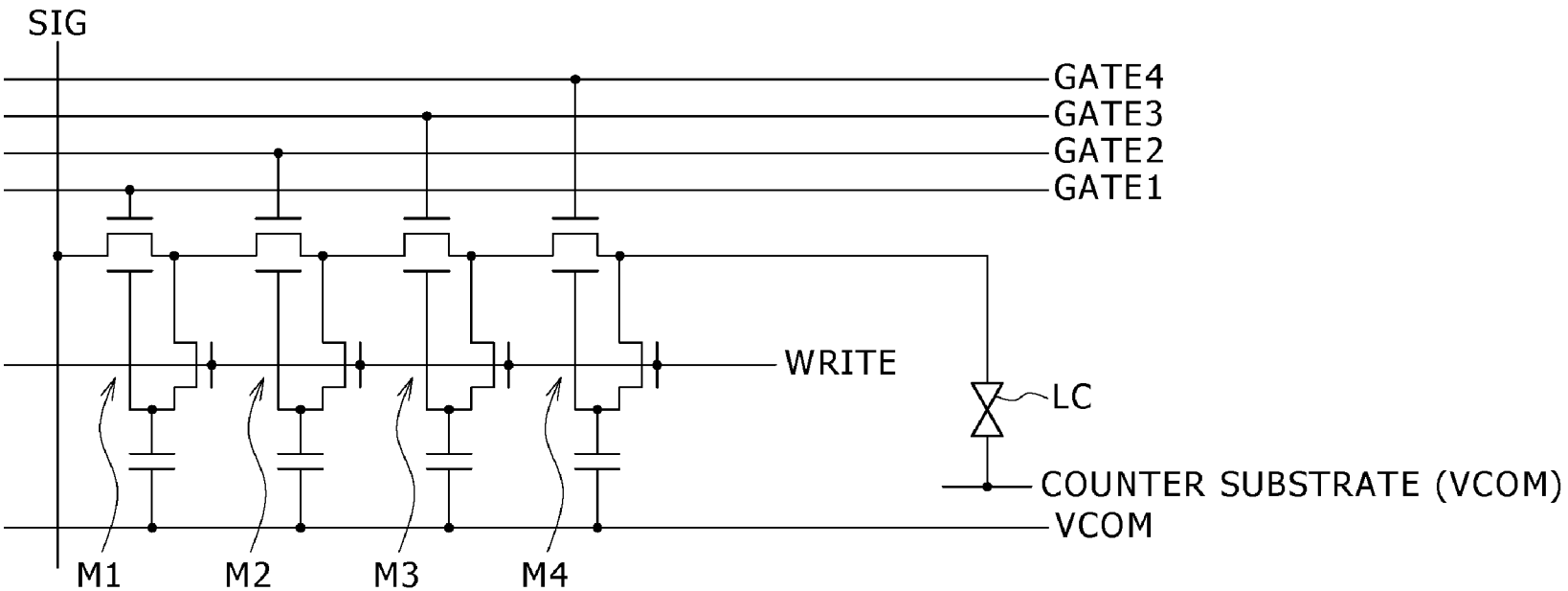
FIG. 10 is a circuit diagram of one pixel in a liquid crystal display device according to another embodiment of the present invention.

FIG. 10 is a schematic diagram showing a liquid crystal display device according to another embodiment of the present invention, and shows the circuit configuration of one pixel. In the present embodiment, one pixel includes four memory elements M1 to M4 that are connected in series to each other between a data line SIG and a liquid crystal cell LC. The respective memory elements M1 to M4 are controlled in a time-division manner via plural gate lines GATE1 to GATE 4 each corresponding to a respective one of the memory elements M1 to M4, to thereby write multi-bit data corresponding to multiple grayscales. Furthermore, time-division driving of the liquid crystal cell LC is carried out depending on the written multi-bit data, and thereby the luminance of the liquid crystal cell LC is controlled based on multiple grayscales. In the present embodiment, four one-bit memory elements M1 to M4 are used, and thus the luminance of the liquid crystal cell LC can be controlled based on 16 (=the fourth power of two) grayscales. If six memory elements are connected in one pixel, luminance control based on 64 (=the sixth power of two) grayscales is possible.

Figure 11:
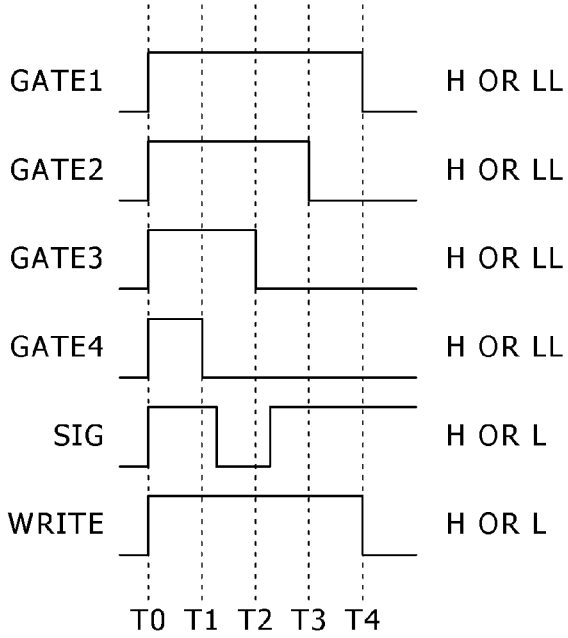
FIG. 11 is a timing chart for explaining the operation of the pixel shown in FIG. 10.

FIG. 11 is a timing chart showing the write operation of the pixel shown in FIG. 10. In the embodiment of FIG. 10, to the memory elements M1 to M4 connected in series to each other, binary data is sequentially written in the order from the memory cell M4, which is closest to the liquid crystal cell LC. Before a write operation start timing T0, all of the gate lines GATE1 to GATE4 are at the level LL, and therefore all of the corresponding dual-gate thin film transistors are in the off-state. The data line SIG is at the level L. A write line WRITE is at the L level, and therefore the switching transistors are also in the off-state. At the write start timing T0, the potential of the entire gate lines GATE1 to GATE4 rises up to the H level, so that all of the dual-gate transistors are turned on. Furthermore, the potential of the data line SIG rises up to the H level. In addition, the potential of the write line WRITE also rises up to the H level, and thus all of the switching transistors are turned on.

This state continues until a timing T1. The data line SIG is at the H level in the period from the timing T0 to the timing T1. Thus, this data H is written to all of the memory elements M1 to M4 temporarily. At the timing T1, only the gate line GATE4 returns to the LL level, so that the corresponding dual-gate thin film transistor is turned off. Thus, the data H written to the memory element M4 closest to the liquid crystal cell LC is fixed at the timing T1. That is, in the period from the timing T0 to the timing T1, the data H is written to the memory element M4. If the data line SIG is at the L level in the period from the timing T0 to the timing T1, the data L is written to the memory cell M4.

Subsequently, in the period from the timing T1 to a timing T2, the data line SIG is at the L level. Therefore, the H level previously written to the memory elements M3, M2, and M1 is rewritten to the L level. At the timing T2, the gate line GATE3 is switched to the LL level, so that the corresponding dual-gate thin film transistor is turned off. Thus, the data L written to the memory element M3 is fixed at the timing T2, and is held as it is from then on.

Subsequently, in the period from the timing T2 to a timing T3, the data line SIG is at the H level. This causes rewriting of the data of the memory elements M2 and M1 from the L level to the H level. At the timing T3, the potential of the gate line GATE2 falls down, so that the dual-gate transistor in the memory cell M2 is turned off. At this timing, the data H is fixed and held in the memory element M2. Thereafter, the data of the H level supplied from the data line SIG is written to the last memory element M1 at a timing T4, in a similar manner. In this way, the binary data of H or L supplied to the data line SIG is sequentially written to the memory elements M4 to M1 in a time-division manner.

Figure 12:
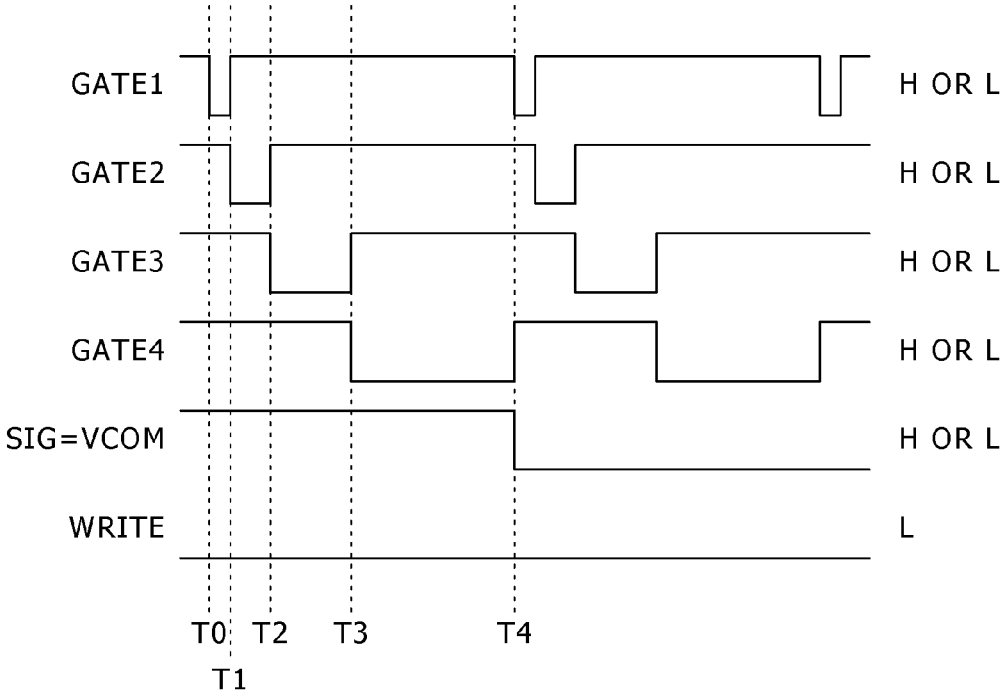
FIG. 12 is a timing chart for explaining the operation of the pixel shown in FIG. 10.

FIG. 12 is a timing chart showing the read operation of the memory elements M1 to M4 shown in FIG. 10. At a timing T0, all of the gate lines GATE1 to GATE4 are at the H level, and thus all of the dual-gate thin film transistors are in the on-state. Therefore, the data line SIG is connected to the pixel electrode of the liquid crystal cell LC via the dual-gate transistors that are connected in series to each other and in the on-state. At this time, the data line SIG is on the H level side with respect to the common potential VCOM. Upon the start of the next field, this H level is switched to the L level. In this manner, the liquid crystal display device according to the embodiment of the present invention carries out alternate current driving by inverting the polarity of the voltage applied to the liquid crystal cell LC with respect to VCOM on a field-by-field basis. The write line WRITE is kept at the L level, and thus all of the switching transistors in the memory elements M1 to M4 are kept at the off-state.

In the period from the timing T0 to a timing T1, only the gate line GATE1 is at the L level, while the other gate lines GATE2 to GATE4 are kept at the H level. Thus, the dual-gate transistors of the memory elements M2, M3, and M4 are kept at the on-state, while only the dual-gate transistor of the memory element M1 is set to the selected state. Specifically, if the data written to the memory element M1 is at the H level, the dual-gate transistor therein enters the on-state, and thus all of four dual-gate transistors connected in series to each other are in the on-state. Consequently, the data line SIG is connected to the pixel electrode of the liquid crystal cell LC, so that the liquid crystal cell LC is in the light-on state. That is, if the data H is written to the memory element M1, the liquid crystal cell LC is kept at the light-on state during the period T0-T1. In contrast, if the data L is written to the memory element M1, the dual-gate transistor therein is in the off-state. Thus, one of four dual-gate transistors connected in series to each other is in the off-state, and therefore the liquid crystal cell LC is isolated from the data line SIG, which results in the light-off state. That is, if the data L is written to the memory element M1, the liquid crystal cell LC is kept at the light-off state during the period T0-T1.

Subsequently, in the period from the timing T1 to a timing T2, only the gate line GATE2 is at the L level, while the other gate lines GATE1, GATE3, and GATE4 are kept at the H level. Thus, the second memory element M2 is set to the selected state, while all of the dual-gate transistors included in the remaining memory elements M1, M3, and M4 are in the on-state. The length of the period T1-T2, during which the memory element M2 is in the selected state, is twice that of the period T0-T1, during which the memory element M1 is in the selected state. If the data H is written to the memory element M2, the liquid crystal cell LC is in the light-on state. In contrast, if the data L is written to the memory element M2, the liquid crystal cell LC is kept at the light-off state during the period T1-T2.

Subsequently, in the period T2-T3, the memory element M3 is set to the selected state, while all of the dual-gate transistors in the remaining memory elements are in the on-state. The length of the period T2-T3, during which the memory element M3 is in the selected state, is twice that of the period T1-T2, during which the memory element M2 is in the selected state. In the period T2-T3, the state of the liquid crystal cell LC is selected from the on-state and the off-state depending on the value L or H of the binary data written to the memory element M3, so that the liquid crystal cell LC is kept at the light-on state or the light-off state during the period T2-T3.

Finally, in the period T3-T4, the gate line GATE4 is turned to the L level, and thus the memory element M4 is set to the selected state. The dual-gate transistors in the remaining memory elements M1, M2, and M3 are in the on-state. During the period T3-T4, the liquid crystal cell LC is in the light-on state or the light-off state depending on the value H or L of the data written to the memory element M4.

As is apparent from the above description, if the binary data H is written to all of the memory elements M1 to M4, the liquid crystal cell LC is kept at the light-on state over the entire period T0-T4. In contrast, if the data L is written to all of the memory elements M1 to M4, the liquid crystal cell LC is kept at the light-off state over the entire period T0-T4. In a state between the all-light-on state and the all-light-off state, in accordance with the multi-bit data written to the memory elements M1 to M4, the liquid crystal cell LC is set to the light-on state and the light-off state, respectively, for the respective periods indicated by the multi-bit data. In this manner, the liquid crystal display device shown in FIG. 10 carries out time-division driving of the liquid crystal cell LC in accordance with the multi-bit data written to the memory cells M1 to M4 of each pixel, and thereby can control the luminance of the liquid crystal cell LC based on multiple grayscales.

Figure 13:
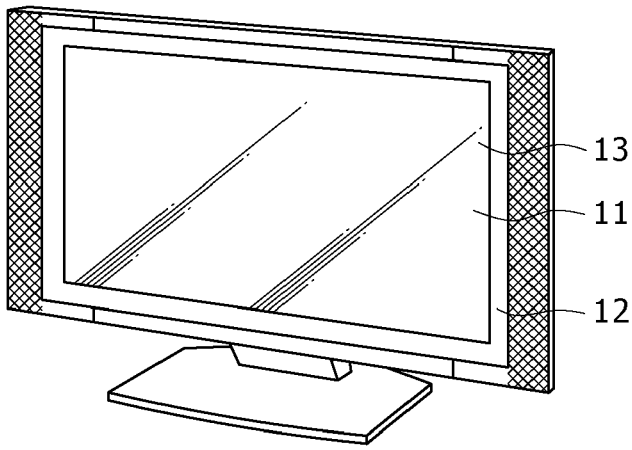
FIG. 13 is a perspective view showing a television set including the display device according to the embodiment.

FIG. 13 shows a television to which the embodiment of the present invention is applied. This television includes a video display screen 11 composed of a front panel 12, a filter glass 13, and so on, and is fabricated by using the display device according to the embodiment of the present invention as the video display screen 11.

Figure 14:
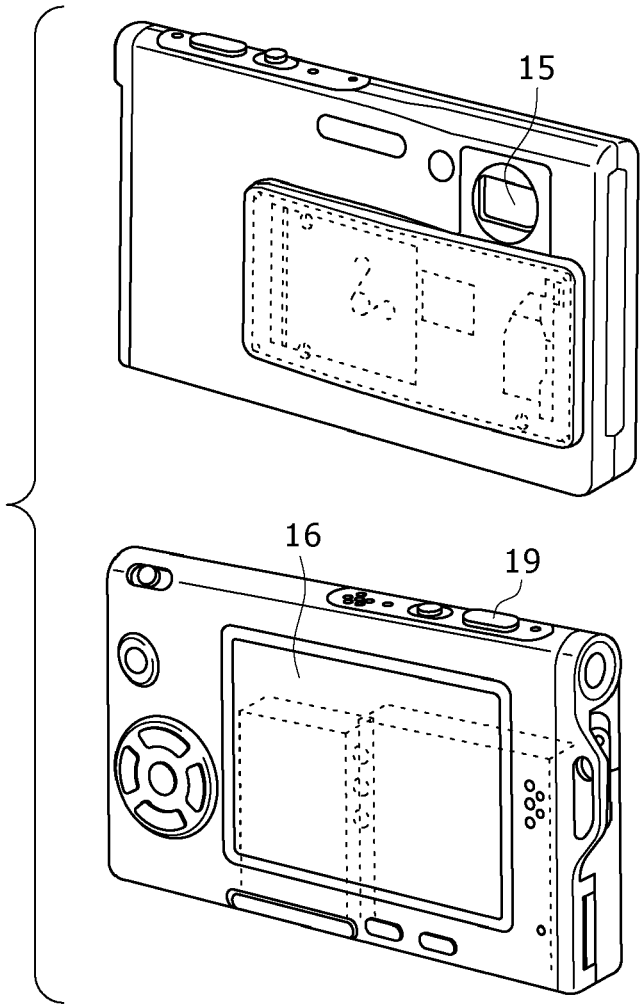
FIG. 14 is a perspective view showing a digital still camera including the display device according to the embodiment.

FIG. 14 shows a digital camera to which the embodiment of the present invention is applied: the upper diagram is a front view and the lower diagram is a rear view. This digital camera includes an imaging lens, a light emitter 15 for flash, a display part 16, a control switch, a menu switch, a shutter button 19, and so on, and is fabricated by using the display device according to the embodiment of the present invention as the display part 16.

Figure 15:
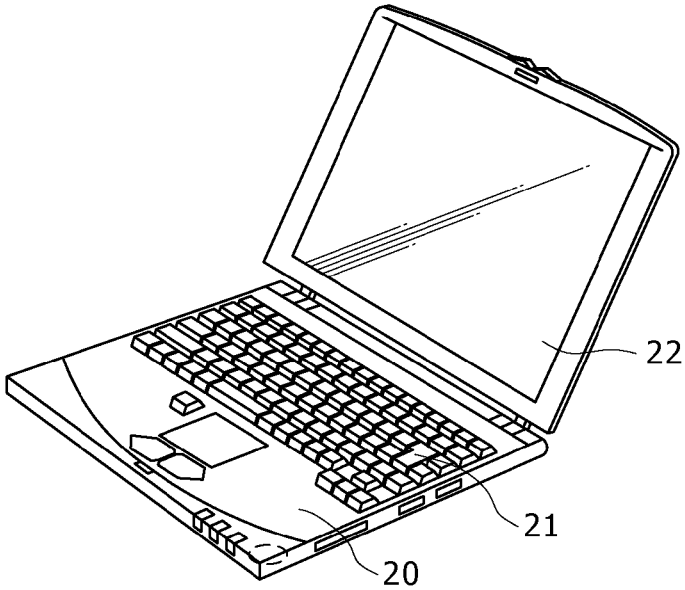
FIG. 15 is a perspective view showing a notebook personal computer including the display device according to the embodiment.

FIG. 15 shows a notebook personal computer to which the embodiment of the present invention is applied. A main body 20 thereof includes a keyboard 21 that is operated in inputting of characters and so on, and the body cover thereof includes a display part 22 that displays images. This personal computer is fabricated by using the display device according to the embodiment of the present invention as the display part 22.

Figure 16:
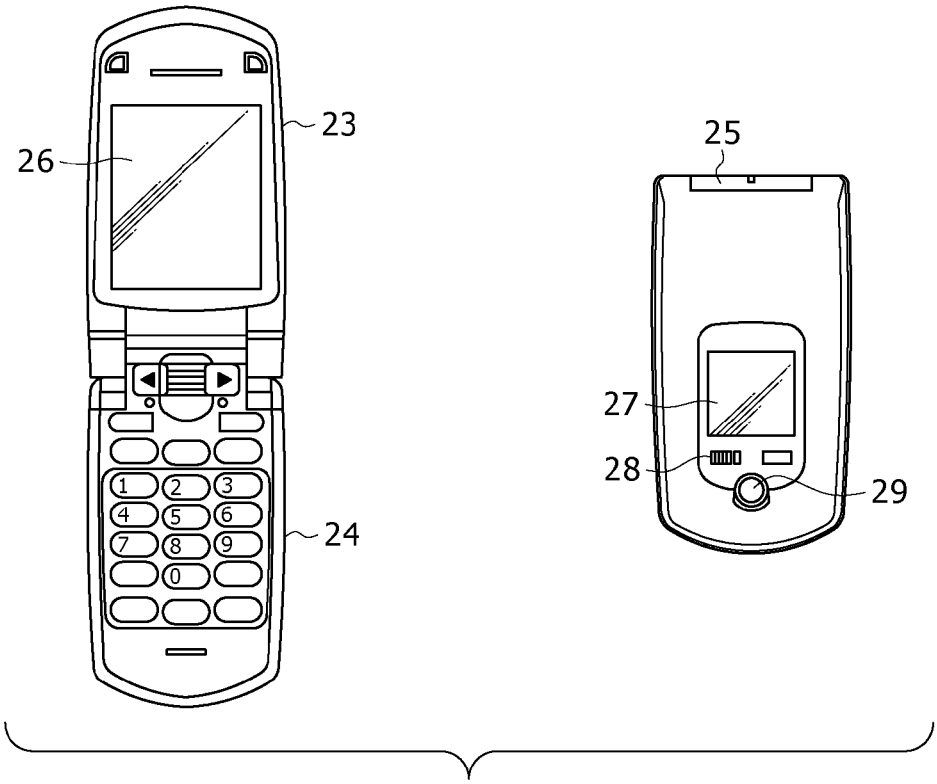
FIG. 16 is a schematic diagram showing portable terminal apparatus including the display device according to the embodiment.

FIG. 16 shows portable terminal apparatus to which the embodiment of the present invention is applied: the left diagram shows the opened state and the right diagram shows the closed state. This portable terminal apparatus includes an upper casing 23, a lower casing 24, a connection (hinge) 25, a display 26, a sub-display 27, a picture light 28, a camera 29, and so on. This portable terminal apparatus is fabricated by using the display device according to the embodiment of the present invention as the display 26 and the sub-display 27. In the display device according to the embodiment of the present invention, a multi-bit memory can be incorporated in the pixel, and thus the power consumption due to charging and discharging of data lines, which occupies most part of the panel power consumption other than the power consumption of the backlight, can be reduced. Thus, an active-matrix liquid crystal display device panel that can be driven with low power consumption can be achieved. Incorporating such a liquid crystal panel into the monitor of the portable terminal apparatus allows not only extension of the interval of battery charging but also reduction in the battery volume, which can further decrease the size of the portable terminal apparatus.

Figure 17:
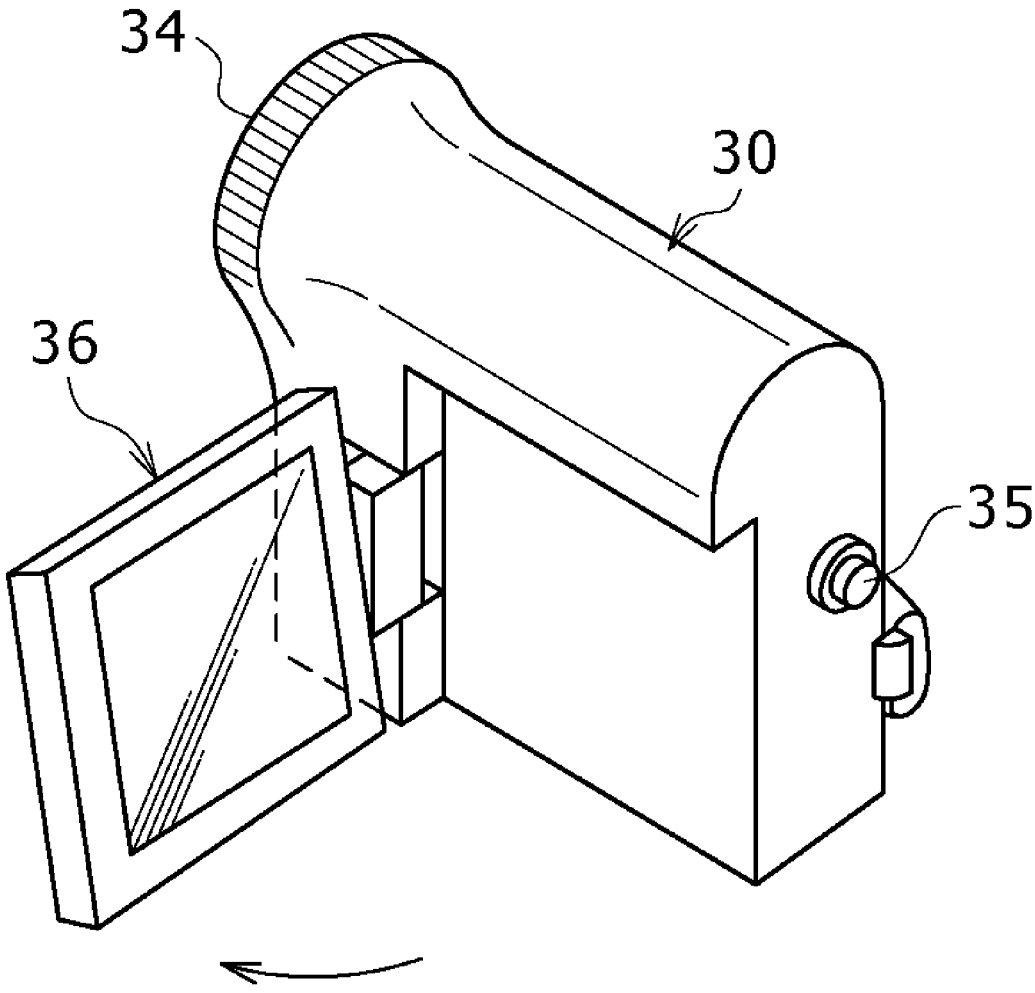
FIG. 17 is a perspective view showing a video camera including the display device according to the embodiment.

FIG. 17 shows a video camera to which the embodiment of the present invention is applied. This video camera includes a main body 30, a lens 34 that is disposed on the front side of the camera and used to capture a subject image, a start/stop switch 35 for imaging operation, a monitor 36, and so on. This video camera is fabricated by using the display device according to the embodiment of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A memory element comprising:

a thin film transistor having a semiconductor thin film and a pair of gate electrodes that vertically sandwich the semiconductor thin film with insulating films between each of the gate electrodes and the semiconductor thin film, the thin film transistor having a source and a drain;

a capacitor connected to a first gate electrode of the pair of gate electrodes; and a switch electrically interposed between the drain of the thin film transistor and the capacitor, wherein, the capacitor is configured to store data, and the data that is stored in the capacitor is configured to be read out by controlling a second gate electrode of the pair of gate electrodes.

2. The memory element according to claim 1, wherein:

the source of the thin film transistor is an input current terminal and corresponds to a data input side and the drain of the thin film transistor is an output current terminal and corresponds to a data output side, in data writing, the second gate electrode is controlled in a state in which the switch is in an on-state, to thereby write data supplied from the input current terminal to the capacitor, and in data reading, the second gate electrode is controlled in a state in which the switch is in an off-state, to thereby read out data written to the capacitor to the output current terminal.

3. The memory element according to claim 2, wherein:

a threshold voltage of the thin film transistor changes due to application of a voltage that is dependent upon data written to the capacitor to the first gate electrode, and the data stored in the capacitor is read out by controlling the second gate electrode and by regarding a change of the threshold voltage as a change between an on-state and an off-state of the thin film transistor.

4. A display device including rows of gate lines, columns of data lines, and pixels disposed at intersections of the gate lines and the data lines, each of the pixels including a memory element and an electro-optical element, each memory element storing data supplied from a respective data line and reading out data in accordance with a signal supplied from a respective gate line, the electro-optical element offering luminance dependent upon the stored data, each memory element comprising:

a thin film transistor having a semiconductor thin film and a pair of gate electrodes that vertically sandwich the semiconductor thin film with insulating films between each of the gate electrodes and the semiconductor thin film, the thin film transistor having a source and a drain;

a capacitor connected to a first gate electrode of the pair of gate electrodes, and a switch electrically interposed between the drain of the thin film transistor and the capacitor, wherein, the capacitor is configured to store data, and the data that is stored in the capacitor is configured to be read out by controlling a second gate electrode via the respective gate line.

5. The display device according to claim 4, wherein:

the source of the thin film transistor is an input current terminal connected to the data line and the drain of the thin film transistor is an output current terminal connected to the electro-optical element, in data writing, the second gate electrode is controlled via the respective gate line in a state in which the switch is in an on-state, to thereby write data supplied from the input current terminal to the capacitor, and in data reading, the second gate electrode is controlled via the respective gate line in a state in which the switch is in an off-state, to thereby read out data written to the capacitor to the output current terminal.

6. The display device according to claim 5, wherein the switch is formed of a thin film transistor and is shielded from external light for prevention of data leakage.

7. The display device according to claim 4, wherein:

the pixel includes a plurality of memory elements that are connected in series to each other between the data line and the electro-optical element, the memory elements are controlled in a time-division manner via a plurality of gate lines each corresponding to a respective one of the memory elements, to thereby write multi-bit data corresponding to multiple grayscales, and time-division driving of the electro-optical element is carried out in accordance with written multi-bit data, to thereby control luminance of the electro-optical element based on multiple grayscales.

8. The display device according to claim 4, wherein:

the pixel is subjected to area division into a plurality of regions, each of the regions includes the electro-optical element and the memory element, and multi-bit data is written to a plurality of memory elements disposed in a plurality of regions, to thereby control luminance of the pixel based on multiple grayscales in accordance with the written multi-bit data.

* * * * *